US009815603B2

(12) United States Patent
Bannini

(10) Patent No.: US 9,815,603 B2
(45) Date of Patent: Nov. 14, 2017

(54) ANTI-TAMPER SYNTHETIC ELASTOMERIC CAP STRUCTURE AND METHOD OF PRODUCTION

(71) Applicant: SUPERCAP S.R.L., Mombaroccio (IT)

(72) Inventor: Mirco Bannini, Pesaro (IT)

( * ) Notice: Subject to any disclaimer, the term of this patent is extended or adjusted under 35 U.S.C. 154(b) by 0 days.

(21) Appl. No.: 14/914,049

(22) PCT Filed: Aug. 25, 2014

(86) PCT No.: PCT/EP2014/067987
§ 371 (c)(1),
(2) Date: Feb. 24, 2016

(87) PCT Pub. No.: WO2015/028420
PCT Pub. Date: Mar. 5, 2015

(65) Prior Publication Data

US 2016/0221732 A1 Aug. 4, 2016

(30) Foreign Application Priority Data

Aug. 29, 2013 (IT) ..... PS2013A0014

(51) Int. Cl.

| | |
|---|---|
| ***A61J 1/00*** | (2006.01) |
| ***B65D 51/24*** | (2006.01) |
| ***B65D 39/16*** | (2006.01) |
| ***B65D 41/16*** | (2006.01) |
| ***B65D 50/00*** | (2006.01) |

(52) U.S. Cl.
CPC ..... *B65D 51/245* (2013.01); *B65D 39/16* (2013.01); *B65D 41/16* (2013.01); *B65D 50/00* (2013.01); *B65D 2101/0038* (2013.01)

(58) Field of Classification Search
CPC .... B65D 41/58; B65D 39/0017; B65D 41/62; B65D 39/04; B65D 41/24; B65D 41/30; B65D 50/00
See application file for complete search history.

(56) References Cited

U.S. PATENT DOCUMENTS

| | | | | |
|---|---|---|---|---|
| 3,191,790 | A * | 6/1965 | Coven | B65D 41/62 215/251 |
| 8,281,944 | B2 * | 10/2012 | Battegazzore | B65D 41/3428 215/219 |
| 8,757,408 | B2 * | 6/2014 | Joubert | B65D 23/085 215/227 |
| 9,254,943 | B2 * | 2/2016 | Brooks | B65D 41/28 |
| 2010/0012615 | A1 * | 1/2010 | Brooks | B65D 41/28 215/256 |

FOREIGN PATENT DOCUMENTS

| | | | |
|---|---|---|---|
| EP | 2468652 | A1 | 6/2012 |
| WO | WO9627533 | A1 | 9/1996 |
| WO | WO2014041442 | A1 | 3/2014 |

* cited by examiner

*Primary Examiner* — Shawn M Braden
(74) *Attorney, Agent, or Firm* — Themis Law

(57) ABSTRACT

An anti-tamper synthetic elastomeric cap structure, of the type having a dilated external head in abutment with an apex to form a "T-cap", includes a composite structure having, embedded in the head, an endoskeleton with external appendages that provides a cage having a circumferential projection, with respect to a penetrating body under the head that defines a band having a notching therein and disposed about the neck of a bottle to provide a pre-fracture line and a grasping appendage.

3 Claims, 2 Drawing Sheets

ANTI-TAMPER SYNTHETIC ELASTOMERIC CAP STRUCTURE AND METHOD OF PRODUCTION

FIELD OF THE ART

Figure 1:
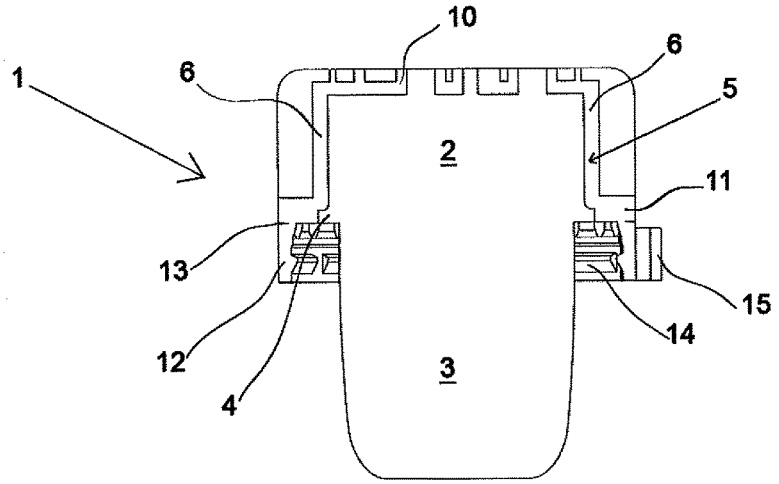

Over the last years, natural cork, or the material most commonly used for manufacturing wine bottle caps, has been used alongside caps made of synthetic elastomeric material, both thermosetting and thermoplastic, in particular thermoplastic elastomers (TPE), adapted for total insertion into the neck of the bottle just like the conventional cork caps, to constitute a valid subsidiary.

An alternative embodiment of such caps, which is also similar to conventional cork cap solutions, is constituted by configurations with widened external head for grasping and abutment, associated to a lower penetrating body, these solutions commonly being referred to as "T-caps"

These solutions are often applicable in dessert wines, liquor wines and liquors; and in products tendentially intended not to be consumed all at once immediately after opening, like, on the contrary, usually intended for wine bottles intended for tendentially immediate complete consumption tendentially for complete insertion into the neck of the bottle and removal with corkscrew.

A series of such preferred use of the "T-cap" lies in the need of application of anti-tamper devices thereonto, or that require the need the proof of opening of the bottle through the removal of un seal, devices which are internationally defined as "tamper evident".

The prior art already recognises "tamper evident" systems for synthetic "T-caps", for example those described in the patent documents U.S. Pat. No. 4,084,719 and RU2426678.

In addition, the solutions according to the prior art on the one side do not adapt to the elastomeric caps or, on the other, they require the intervention application of the anti-tamper device subsequent to the obtainment of the cap, which thus considerably increases the processes, times and implementation costs.

OBJECTS OF THE INVENTION

Thus, in this context, the main object of the present invention is to provide a cap made of elastomeric material, with method of relative production, with a "T-cap" structure for bottles, preferably of the type made up of thermoplastic elastomers (TPE), having an a feasible anti-tamper or "tamper evident" functionality.

Another object of the present invention is to obtain the preceding function through a cap and a method of relative production leading to a functionality integrated and incorporated in the structure of the cap so that, in structural terms, it is monolithic and, in terms of production, it can be obtained in a single piece and single process, without substantial revolution with respect to the production processes according to the prior art, so as to be able to obtain the previously existent machinery and devices, with limited adaptation solutions.

Another object of the present invention is to attain the previous objects through a cap and a method of relative production also capable of allowing to serve decorative and/or distinctive functions.

A further object of the present invention is to attain the previous objects through a cap and a method of relative production that are simple and efficient, safe in use and relatively economic considering the results attained therewith.

SUMMARY OF THE CONCEPT SOLUTION

These and other objects are attained with the anti-tamper synthetic elastomeric cap structure, especially for wine and liquor bottles, particularly of the type with dilated external head in abutment with the apex of the type called "T-cap", according to the present invention, comprising a composite constitution for aggregation of material (5) preferably plastic tolerating pre-fracture lines with elastomeric mass (1), by embedding in the head (2) of an endoskeleton (5) with external appendages (10, 11, 12, 15) to constitute a cage (5), preferably surfacing at the upper part (10) of the head (2) and projecting circumferentially (11) with respect to the penetrating body (3) under the head (2) to define a band (12) therein notching (14) the neck of the bottle with the pre-fracture line (13) and grasping appendage (15); as well with method of relative production according to the present invention, comprising arrangement of material tolerating pre-fracture lines (5), preferably pre-moulded plastic material, to form a cage (5), within the injection mould of the thermoplastic resin, preferably shaped so that the apex (10) of the cage (5) contacts the top wall of the mould and so that a lower band (11, 12, 15) of the cage (5) is inserted into a receptacle surrounding the compartment defining the penetrating body (3), injection of the thermoplastic resin and ensuing trapping of the cage (5) in the monolithic elastomeric mass (1) thus obtained to form a solid geometry (1) obtained by the mould, where the resin incorporates the cage (5) and it is inserted into contingently shaped receptacles (10) provided on the apex of the cage (5) to define lateral characters and/or surface figurative elements in the finished product, and where a portion (11, 12, 15) of the cage (5) projects externally circumferentially with respect to the penetrating body (3) under the head (2) in the finished product to constitute a band (12) therein notching (14) the neck of the bottle with the pre-fracture line (13) and grasping appendage (15).

DESCRIPTION OF THE ATTACHED DRAWINGS

Figure 2:
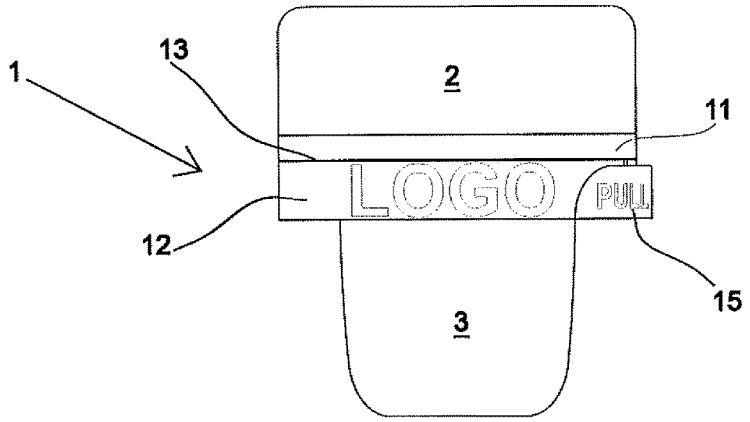
Figure 3:
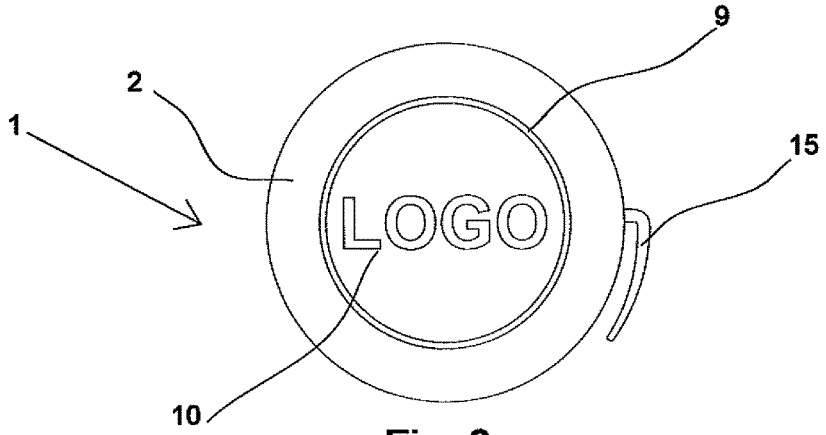
Figure 4:
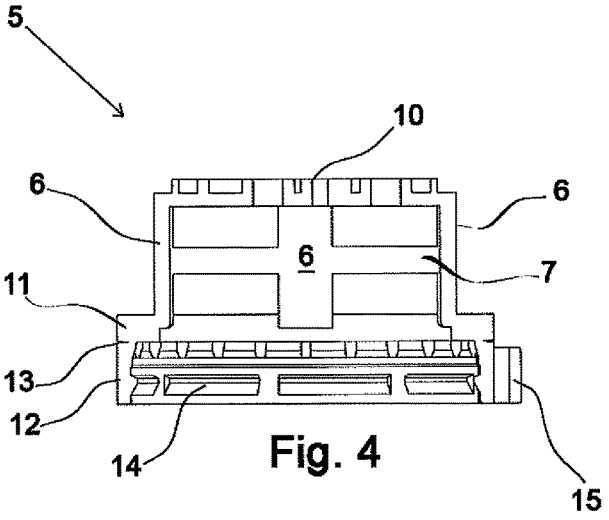
Figure 5:
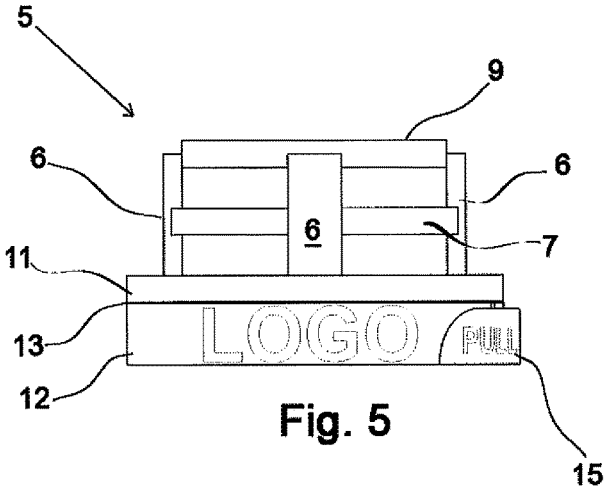
Figure 6:
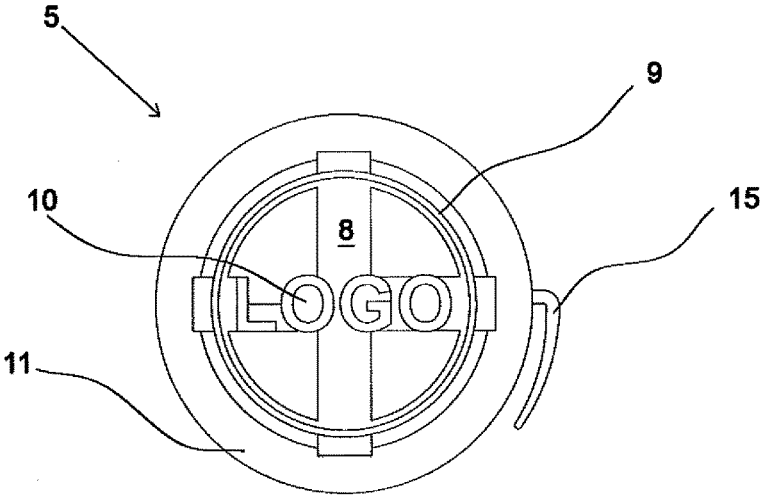

Further characteristics and advantages of the anti-tamper synthetic elastomeric cap structure of the type a dilated external head in abutment with the apex of penetrating body and the method of relative production, according to the present invention, shall be more apparent from the following detailed description of a preferred but non-exclusive embodiment thereof, represented solely by way of non-limiting example in the two attached drawings, wherein:

FIGS. 1 to 3 respectively show in vertical sectional view, lateral profile and plan view, an anti-tamper synthetic elastomeric cap structure of the type a dilated external head in abutment with the apex of penetrating body according to the present invention;

FIGS. 4, 5 and 6 respectively show in vertical sectional view, lateral profile and plan view, a constituting element of the anti-tamper synthetic elastomeric cap structure of the type having a dilated external head in abutment with the apex of a penetrating body according to the present invention.

STATIC DESCRIPTION OF THE EMBODIMENT

With reference to such figures and in particular FIG. 1, an exemplifying structure, schematically illustrated in vertical section, of the anti-tamper elastomeric cap, of the type with dilated external head in abutment with the apex of penetrating body, also referred to as "T-cap", according to the present invention, which shows the relative composite structure, having the relative elastomeric body, also indicated with reference number 1, an internal armour or endoskeleton 5, with portions projecting externally come as described hereinafter is indicated in its entirety with 1.

The cap 1 comprises a dilated upper head 2, preferably tendentially cylindrical-flat, adapted to abut at the lower part, through a circular crown portion thereof 4, against the edge of the neck of the bottle, not illustrated, it is intended to close;

The cap 1 further comprises a penetrating cylindrical body 3, defined centrally at the lower part of the head 2, to internally limit therein, therearound, said circular crown 4, as well intended to be inserted and penetrate with the entire extension thereof into the neck of the bottle and perform actual closing functions.

A cage or armour, generally substantially cylindrical-shaped in the illustrated example (also see FIGS. 4 to 6), preferably obtained by moulding in a single piece made of plastic material tolerating pre-fracture processes is indicated in its entirety with 5.

In the illustrated embodiment, the cage or cylindrical armour 5 is constituted by four uprights 6, angularly interspaced by 90° (ninety nonagesimal degrees), mutually circumferentially bound at about half height by a belt 7.

The four uprights 6 are at the upper part orthogonally inwardly bent and mutually intersected to form a crosspiece 8, surrounded by a circumferential tab 9, at the top part at the cage or cylindrical armour 5.

In the illustrated example, an arm of the crosspiece 9 is shaped and machined in bas relief and/or tracery to define shapes, projections and receptacles for obtaining an image and/or a drawing 10 surfacing at the upper part of the head 2, as subsequently illustrated further hereinafter.

The four uprights 6 are joined—at the base—by a convex ring 11, at the lower part coplanar to said circular crown 4, which it delimits externally.

To the ring 11 there is joined, through a pre-fracture line 13, a strip 12, within which there projects a line of convex teeth 14 and—at an end thereof—a grasping appendage 15.

The embodiment of such innovative structure of the composite product is attained through the method according to the present invention, whose implementation provides for at least one injection mould, modified with respect to the usual injection moulds for elastomeric "T-caps", with the aim of housing the cage or cylindrical armour 5 in suitable compartments.

The cage or cylindrical armour 5 arranged within the mould is in turn previously manufactured in a known manner, by moulding the plastic material suitable to tolerate the pre-fracture lines of which it is made.

The mould of the anti-tamper "T-cap" according to the present invention is preferably shaped so that the apex of the cylindrical cage 5 contacts the top wall of the mould and so that the lower strip 13 of the cage 5 is inserted into a complementary receptacle surrounding the matrix interface of the circular crown 4 and the compartment defining the penetrating body 3, so that said strip 13 is not covered by the elastomeric materials after the injection described hereinafter.

Within the mould thus provided the elastomeric resin, for example a thermosetting elastomer, but preferably at least one thermoplastic elastomer (TPE) associated to at least one expansion agent, according to the prior art, is injected for the obtaining of elastomeric caps subsidiary to natural cork, with possible addition of pigments, lubricants and also further addition, such as natural cork powder as a filler or inert load, to simultaneously also obtain greater similarity to natural cork (contingently compare with the object of the Italian patent application n° PS2013A000006 filed on 10 May 2013 on behalf of the applicant Supercap S.r.1.).

The injection of the thermoplastic resin leads to the the trapping of the cage 5 in the monolithic elastomeric mass thus obtained, to form a solid two-component geometry 1, obtained by the mould;

in such solid geometry 1 the resin is inserted and the residue is lodged in the contingently shaped receptacles 10 provided on the apex of the cage 5 to form lateral characters and/or surface figurative elements in the finished product, conceived to constitute and/or reproduce logos and distinctive marks of the manufacturer and/or bottler applying the solution of the specific cap according to the present invention and which can be suitably personalised;

in the same solid geometry 1 a portion of cage 5 constituted by the strip 12 projects externally circumferentially with respect to the penetrating body 3 under the head 2 in the finished product, to constitute a notching strip therein in the neck of the bottle with the pre-fracture line 13 and grasping appendage 15 for the functions to be specified below.

DYNAMIC DESCRIPTION OF THE PREFERRED EMBODIMENT

Thus, having completed the static description of a preferred embodiment of the anti-tamper synthetic elastomeric cap structure of the type with dilated external head in abutment with the apex of penetrating body and the method of relative production according to the present invention, below is the dynamic description, or the relative operation:

as mentioned above, the anti-tamper elastomeric "T-cap" 1 according to the present invention may be personalised at will:

the cage 5, may obviously be differently shaped to suit the purpose, in particular it may be disc-shaped at the top part, or cross-shaped like in the illustrated embodiment, or in any other way;

regardless of the relative apical structural configuration, it can be machined in such area with groove, bas relief, channel and tracery 10, contingently suitably providing the relative mould, so that when the cage 5 is embedded in the elastomeric material during the injection, it is introduced into the matrix interspaces 10 of the image and/or drawing, counter-faced near the the wall of the mould, so that in the finished product there are configurations of words and/or symbols, which can be alternatively obtained projecting, or with the elastomeric material marking characters and signs, or recessed, or with the elastomeric material contouring characters and signs defined by top projections of the cage 5, or combined solutions.

Regardless of and alongside such decorative solutions, the anti-tamper elastomeric "T-cap" 1 according to the present invention attains the anti-tamper or "tamper evident" functions;

for such purpose, the cap 1 exits from the production moulds with the lower strip 12 surrounding the penetrating body 3 and, when it is inserted into the neck of the bottle by specifically conceived automatic, the convex teeth 14 of the removable strip 13 notch the special external circumferential reliefs of the neck of the bottle, so that the cap cannot be extracted, unless by removing the strip 12, or stripping it off through the grasping element provided by the tongue 15 and along the pre-fracture line 13, thus attaining the object of proving the stripping and thus proving the bottle has been tampered with.

Alternative Embodiments

It is obvious that in further alternative embodiments, still falling within the same concept solution under the embodiment illustrated above and claimed below, the Anti-tamper synthetic elastomeric cap structure of the type a dilated external head in abutment with the apex of penetrating body and the method of relative production according to the present invention, may be obtained or implemented with equivalent technical and structural elements, or provided with further supplementary solutions, same case applying to all configurations of the relative constituents and the implementation interventions may vary to suit the purpose;

in particular, purely by way of exemplifying and non-limiting solution:

the cage constituting the endoskeleton of the composite structure may be structured and shaped in any other manner suitable for the purpose, as well obtained using any material, plastic or non-plastic, capable of allowing obtaining the functions required thereof:

as previously mentioned in the dynamic description, the top part of the cage or endoskeleton, intended to surface and/or bearing the elements intended to surface to obtain the wording and/or figurative element, may be variously shaped to suit the purpose;

the lower part of the cage or endoskeleton, intended to surface and project around the neck for fasten it and leave traces of the relative removal, may be obtained differently anchored and shaped with respect to the embedded part.

Advantages of the Invention

As clear from the detailed description of the preferred embodiments above, the anti-tamper synthetic elastomeric cap structure of the type a dilated external head in abutment with the apex of penetrating body and the method of relative production according to the present invention, offer advantages corresponding to the attainment of these and other preset objects:

They provide all functional positive characteristics of the thermosetting thermoplastic elastomeric (TPE) synthetic caps, simultaneously obtaining the anti-tamper or "tamper evident" functions provided on the moulded two-component composite structure, without requiring further post-production interventions on the product to associate retention elements thereon.

Simultaneously the solution concept of the moulded two-component composite structure offers the additional opportunity and advantage of conferring indelible decorative and distinctive marks to the finished product, also in this case without requiring further post-production interventions on the product to decorate and/or personalise it.

KEY TO THE REFERENCE NUMBERS

1) cap in its entirety
2) head of the cap
3) penetrating body of the cap
4) circular abutment crown under the head and around the penetrating body
5) cage or cylindrical armour in its entirety
6) four uprights of the cage
7) median belt binding the four uprights of the cage
8) upper crosspiece of the cage
9) circumferential tab circumscribing the upper crosspiece of the cage
10) image and/or drawing
11) lower ring of the cage
12) removable strip
13) pre-fracture line
14) convex teeth of the removable strip
15) grasping appendage of the removable strip

The invention claimed is:

1. An anti-tamper synthetic elastomeric cap structure, especially for wine and liquor bottles, shaped as a T-cap, comprising:

a composite structure having a head and a penetrating body made from an elastomeric material; and a tearable portion coupled to an inner part of the head, wherein the tearable portion comprises:

an endoskeleton configured as a cage or armor;

a plurality of projections extending from the endoskeleton and around a part of the penetrating body, wherein the plurality of the projections engage a neck of a bottle, wherein the plurality of projections engaging the neck of the bottle are provided in a strip having a grasping appendage and a fracture element that protects the bottle from tampering, wherein the endoskeleton is embedded in the head, and wherein the fracture elements are defined by having one or more pre-fracture lines in the strip.

2. The anti-tamper synthetic elastomeric cap structure according to claim 1, wherein the plurality of projections engaging the neck of the bottle are supported by an outer band surrounding an upper portion of the neck of the bottle, the outer band carrying a writing or drawing visible by a user.

3. The anti-tamper synthetic elastomeric cap structure according claim 1, wherein the endoskeleton has a cylindrical configuration and comprises a plurality of uprights that are:

coupled, at an upper part, to a member disposed at an upper end of the head; and joined, at a base, by a ring, to which the strip is coupled with the one or more pre-fracture lines.

* * * * *